US006392521B1

(12) United States Patent
Clinton

(10) Patent No.: US 6,392,521 B1
(45) Date of Patent: May 21, 2002

(54) VARIABLE INDUCTANCE TRANSFORMER WITH ELECTRONIC CONTROL

(75) Inventor: Henry H. Clinton, Clinton, CT (US)

(73) Assignee: Clinton Instrument Company, Clinton, CT (US)

( * ) Notice: Subject to any disclaimer, the term of this patent is extended or adjusted under 35 U.S.C. 154(b) by 0 days.

(21) Appl. No.: 09/689,015

(22) Filed: Oct. 12, 2000

(51) Int. Cl.[7] ..... H01F 21/06

(52) U.S. Cl. ..... 336/134; 336/178; 336/133; 336/130

(58) Field of Search ..... 336/83, 130, 132–134, 336/178, 229, 165

(56) References Cited

U.S. PATENT DOCUMENTS

| | | | | |
|---|---|---|---|---|
| 894,714 | A | | 7/1908 | Young |
| 1,615,130 | A | | 1/1927 | Milton |
| 2,055,175 | A | | 9/1936 | Franz |
| 2,157,871 | A | | 5/1939 | Steinert |
| 2,305,153 | A | | 12/1942 | Fries |
| 2,450,732 | A | | 10/1948 | Klinkhamer |
| 2,463,170 | A | | 3/1949 | Grignon et al. |
| 2,567,394 | A | * | 9/1951 | Nuttman |
| 2,860,313 | A | | 11/1958 | Israel |
| 3,176,252 | A | | 3/1965 | Spiteri |
| 3,454,854 | A | * | 7/1969 | Booth |
| 3,480,896 | A | * | 11/1969 | Neumna |
| 3,521,210 | A | | 7/1970 | Iwata et al. |
| 3,581,189 | A | | 5/1971 | Sinet |
| 3,622,868 | A | | 11/1971 | Todt |
| 3,671,810 | A | | 6/1972 | Barnes et al. |
| 3,689,861 | A | | 9/1972 | Gibson |
| 4,056,771 | A | | 11/1977 | Clinton et al. |
| 4,086,551 | A | | 4/1978 | Smith |
| 4,164,723 | A | | 8/1979 | Smith |
| 4,206,434 | A | | 6/1980 | Hase |
| 4,229,721 | A | | 10/1980 | Koloczek et al. |
| 4,453,124 | A | | 6/1984 | Francis et al. |
| 4,529,956 | A | * | 7/1985 | Atherton ..... 336/83 |
| 4,620,144 | A | | 10/1986 | Bolduc |
| 5,132,629 | A | | 7/1992 | Clinton et al. |
| 5,612,624 | A | | 3/1997 | Clinton |
| 5,672,963 | A | | 9/1997 | Corrigall et al. |
| 5,731,666 | A | | 3/1998 | Folker et al. |

* cited by examiner

*Primary Examiner*—Anh Mai
(74) *Attorney, Agent, or Firm*—McCormick, Paulding & Huber LLP

(57) ABSTRACT

A variable inductance transformer includes a core defining a gap between opposing first and second ends. A primary winding and at least one secondary winding are coupled to the core. The secondary winding is provided for stepping up the voltage across the primary winding. A carriage assembly includes a magnetic shunt movable against the core and variably across the gap. The magnetic shunt has a width at least as wide as the gap for moving the shunt to a predetermined position along the core in a range from an uncovered position not overhanging the gap, throught intermediate positions overhanging the gap, to a covered position where the shunt bridges the gap. A control circuit controllably energized a motor to move the carrriage assembly and position the magnetic shunt against the core for adjustably varying the inductance of the secondary winding a to maintain a high output voltage of the transformer for a given resistive supply current.

14 Claims, 5 Drawing Sheets

VARIABLE INDUCTANCE TRANSFORMER WITH ELECTRONIC CONTROL

FIELD OF THE INVENTION

This invention relates generally to a transformer, and more particularly to a variable inductance transformer for high voltage applications.

BACKGROUND OF THE INVENTION

Variable inductance transformers are well known devices that provide adjustment to the inductance across the transformer secondary winding. Variable inductance transformers are particularly useful for high voltage applications such as, for example, spark testers which apply high voltage to insulated conductors to detect defects in the insulation such as pinholes through the insulator or other types of defects in the insulator. The amount of inductance across the secondary winding to maintain a predetermined output voltage is partly a function of the capacitance and thickness of the insulator. Conventional variable inductance transformers typically use a variable air gap in the core to adjust the inductance across the secondary winding of the transformer to maintain the output voltage. The size of the air gap is varied, for example, by placing shims in the gap or otherwise mechanically varying the gap. A drawback with these transformers is that high voltage across the secondary of the transformer may drop below a desired level as the capacitance of the object under inspection varies. Further, the current generated at the secondary may rise to levels which could electrocute an operator coming into accidental contact with the output terminal of the transformer.

In view of the foregoing, it is a general object of the present invention to provide a variable inductance transformer which overcomes the above-mentioned drawbacks and disadvantages associated with prior variable inductance transformers.

SUMMARY OF THE INVENTION

In one aspect of the present invention a variable inductance transformer includes a core defining a gap between opposing first and second ends. A primary winding and at least one secondary winding are coupled to the core. The secondary winding is provided for stepping up the voltage across the primary winding. A carriage assembly includes a magnetic shunt movable against the core and variably across the gap. The magnetic shunt has a width at least as wide as the gap for moving the shunt to a predetermined position along the core in a range from an uncovered position not overhanging the gap, through intermediate positions overhanging the gap, to a covered position where the shunt bridges the gap to adjustably vary the inductance of the secondary winding to resonate with a load capacitance.

In another aspect of the present invention a variable inductance transformer system includes a variable inductance transformer having a core defining a gap between opposing first and second ends. The transformer includes a primary voltage input winding, a secondary voltage output winding, and a tertiary voltage test winding. The secondary winding is for generating an output signal having a stepped up voltage relative to that received by the primary winding, and the tertiary winding is for generating a signal having a reduced and proportional voltage relative to that generated by the secondary winding. A carriage assembly includes a magnetic shunt movable against the core and variably across the gap. The magnetic shunt has a width at least as wide as the gap for moving the shunt to a predetermined position along the core in a range from an uncovered position not overhanging the gap, through intermediate positions overhanging the gap, to a covered position where the shunt bridges the gap to adjustably vary the inductance of the secondary winding to resonate with a load capacitance. Means are provided for moving the carriage assembly to position the magnetic shunt against the core.

Preferably the moving means includes a motor having a drive shaft threadably engaging the carriage assembly. The drive shaft is rotatable in clockwise and counterclockwise directions to bidirectionally move the magnetic shunt carried by the assembly to a desired position along the core. Further, a contact surface of the magnetic shunt opposing the core preferably terminates at an edge extending along an oblique angle from a first end to a second end relative to a direction along a longitudinal length of the gap, whereby the gap is progressively bridged by the magnetic shunt from its first end to its second end when the magnetic shunt is moved over the gap. The progressive bridging of the gap is to prevent sudden changes to the inductance of the secondary winding.

The moving means also preferably includes a phase detector having inputs communicating with the input and output sides of the transformer, as well as a servo amplifier having an input coupled to an output of the phase detector, and an output coupled to a control input of the tuning motor for controllably energizing the tuning motor to move the magnetic shunt into a position along the core so that the voltage signals at the input and output sides of the transformer are in a predetermined phase relation to each other. In the preferred embodiment the voltage signals at the input and output sides of the transformer are in phase with each other, and a resistive element, such as an incandescent lamp is placed in series with the primary winding of the transformer to limit the current across the secondary winding should a short circuit occur at the secondary.

An advantage of the present invention is that the inductance of the transformer is automatically varied to bring to or maintain the output voltage at a high value.

Another advantage of the present invention is that the output voltage is maintained at a predetermined level despite fluctuations in the input voltage.

A yet further advantage is that the current at the secondary is limited in the case of short circuit to prevent electrocution.

These and other advantages of the present invention will become more apparent in the light of the following detailed description and accompanying figures.

DETAILED DESCRIPTION OF THE PREFERRED EMBODIMENT

Figure 1:
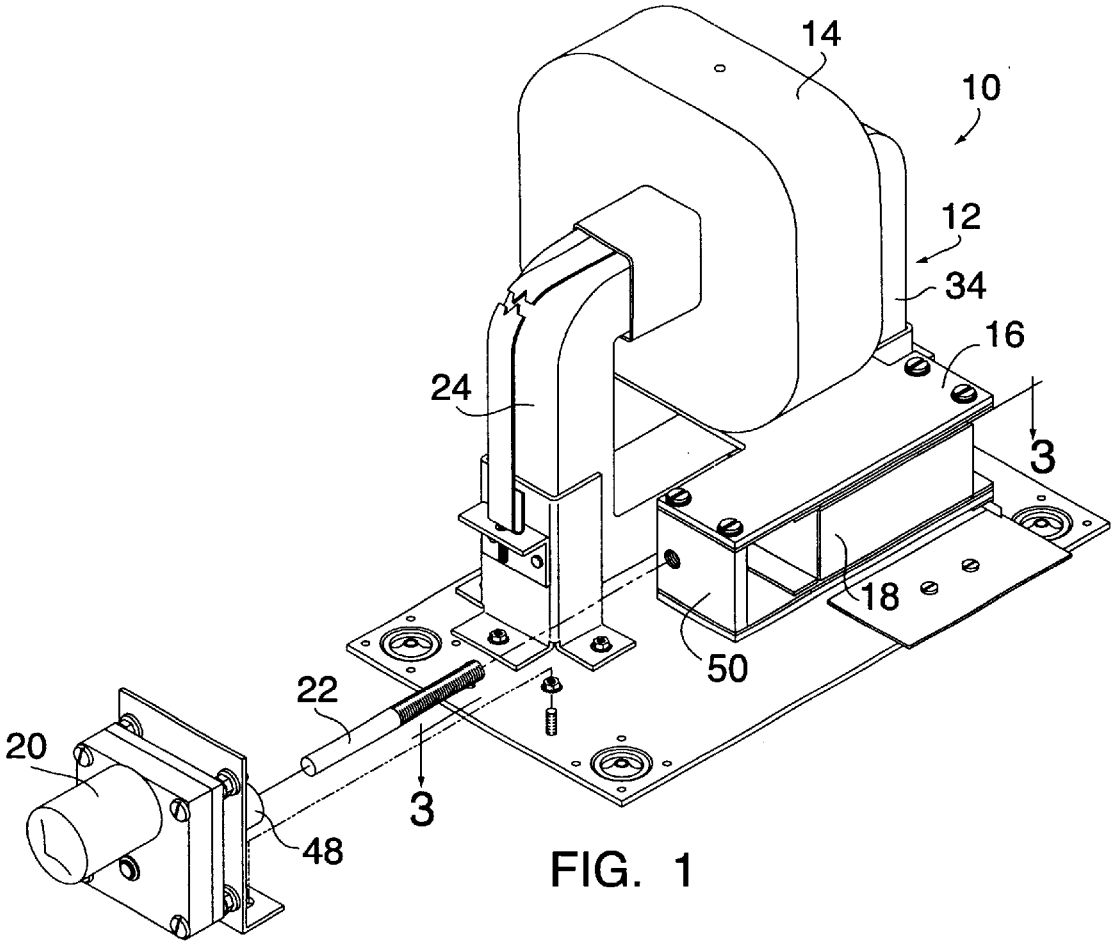
FIG. 1 is a partially exploded perspective view of a variable inductance transformer embodying the present invention.
Figure 2:
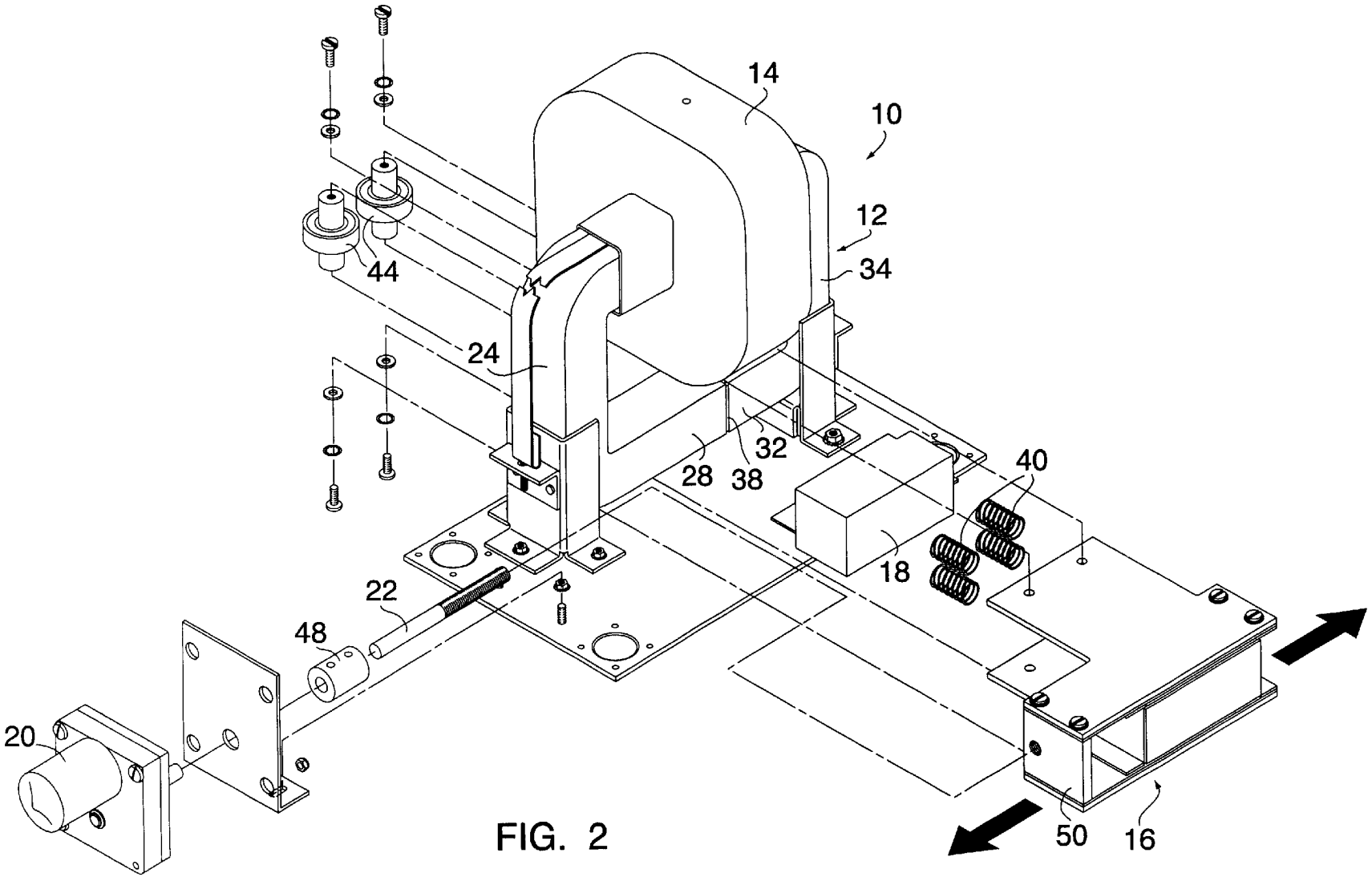
FIG. 2 is another partially exploded perspective view of the variable inductance transformer of FIG. 1 showing the carriage assembly and magnetic shunt.
Figure 3:
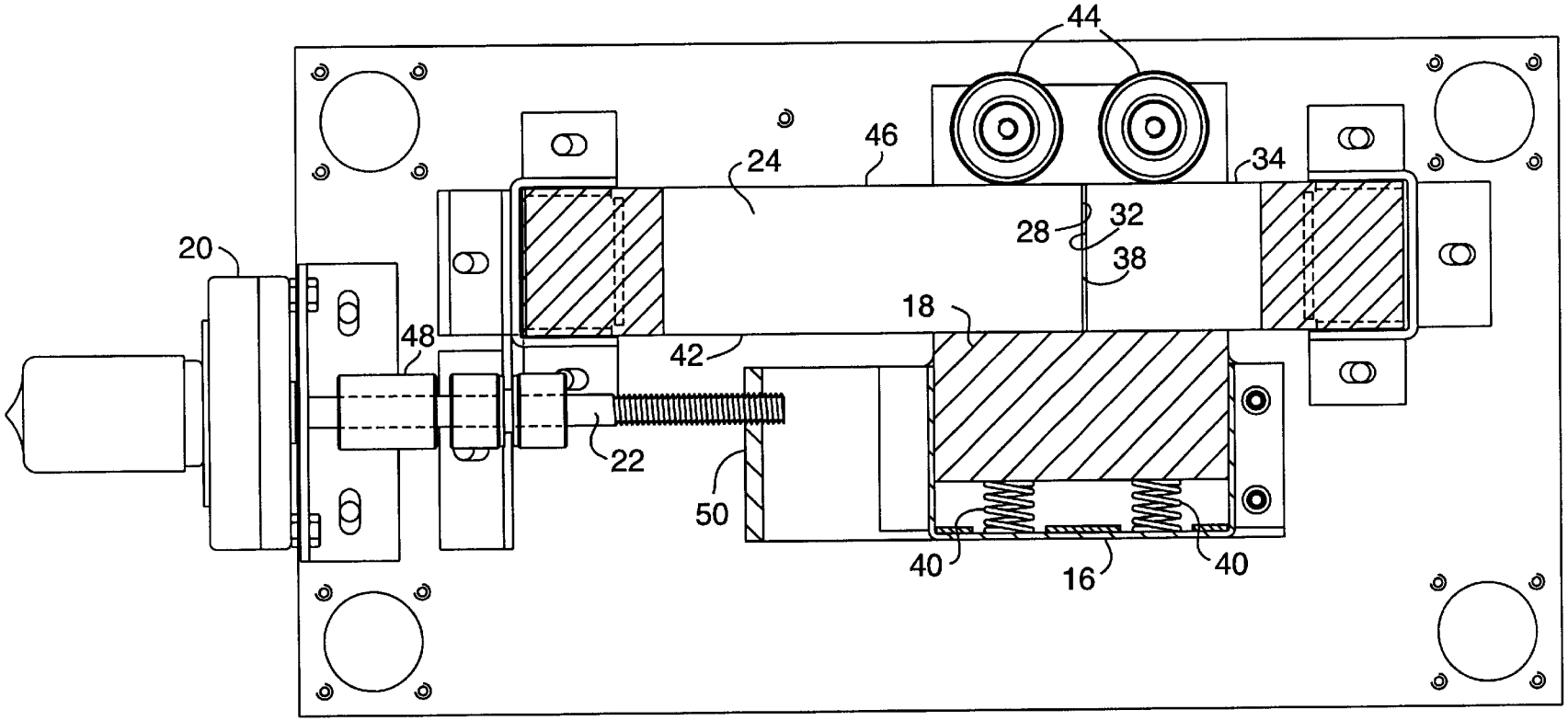
FIG. 3 is a cross sectional, top plan view of the transformer taken along the lines 3—3 of FIG. 1.

Turning to FIGS. 1–3, a variable inductance transformer embodying the present invention is generally designated by the reference number 10. The transformer 10 is a step-up transformer having a high voltage secondary that is employed in high voltage applications, such as product testing. Preferably, the secondary winding of the transformer 10 generates a 0 to about 30 kV sine wave in the frequency range of about 50 Hz to about 60 Hz. As an example, the transformer embodying the present invention will be explained with respect to spark testers that apply a high voltage to an insulated conductor that passes through an electrode to determine whether there are pin holes or other defects in the insulator. The conductor is connected to earth potential such that a through hole in the insulator causes a low current electric arc to be formed along a path from the electrode to ground via the conductor. Although the present invention will be explained with respect to spark testers, it should be understood that the transformer embodying the present invention may be employed in other applications requiring high voltage without departing from the broader aspects of the present invention.

Figure 5:
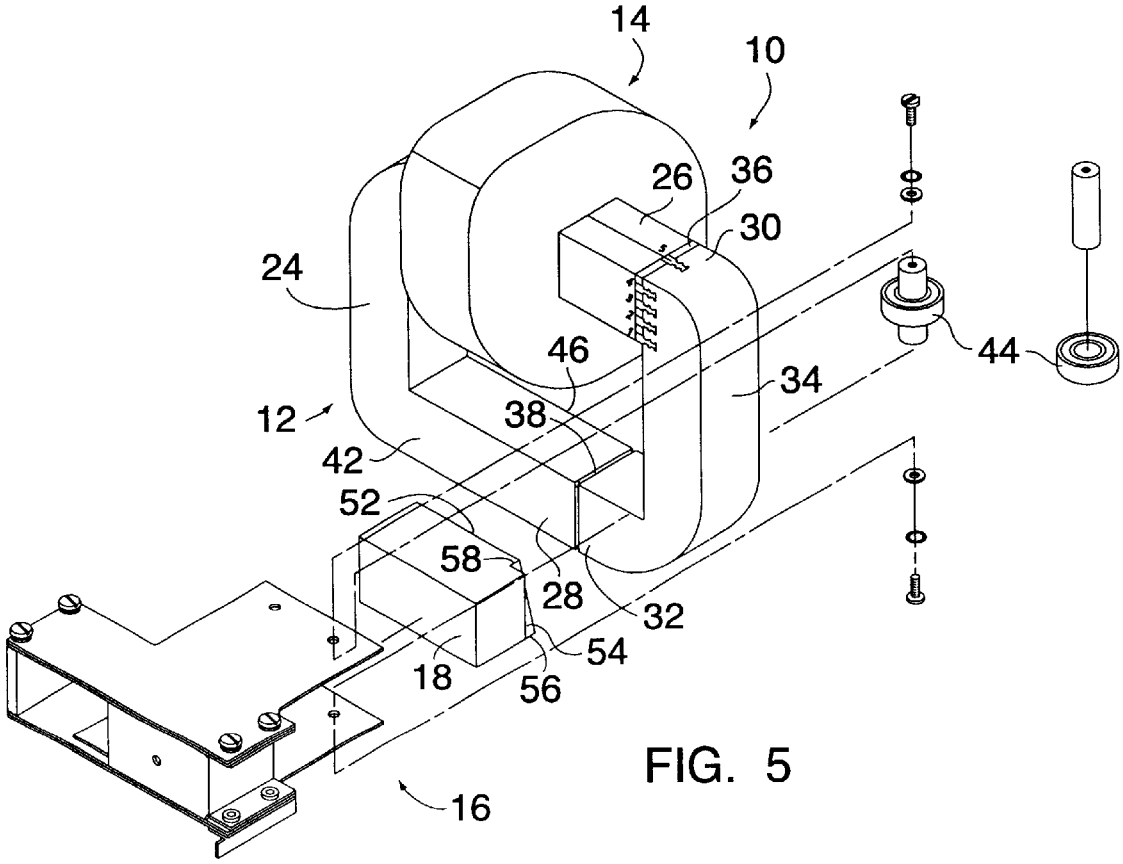
FIG. 5 is an exploded perspective view of the core and magnetic carriage assembly in accordance with the present invention.

The transformer 10 includes a magnetically permeable core 12, a winding assembly 14 having an insulated cover enclosing primary, secondary and tertiary windings (see FIG. 6) mounted to the core, a carriage assembly 16 carrying a magnetic shunt 18 made of magnetically permeable material against the core, and a tuning motor 20 that bidirectionally rotates a threaded drive shaft 22 in clockwise and counterclockwise directions to move and position the carriage assembly relative to the core. As best shown in FIG. 5, the core 12 may be fabricated from two C-shaped core members. A first core member 24 has first and second longitudinal ends 26, 28 that oppose associated first and second ends 30, 32 of a second core member 34. The first ends 26, 30 of the respective core members 24, 34 are butted together at a butt joint 36, and the second ends 28, 32 of the core members oppose and are slightly spaced from one another to define a gap 38 therebetween. As shown in FIG. 5, top and bottom legs of the first core member 24 are longer relative to top and bottom legs of the second core member 34 so that the winding assembly 14 may be attached to the top leg of the first core member prior to joining the core members together, and without covering or otherwise interfering with the butt joint 36. Preferably, a magnetic insulator is disposed within the gap 38 to provide, in part, strength to the core 12.

The insulated cover of the winding assembly 14 encloses a primary winding for applying a mains voltage, such as 120 VAC, a secondary winding for providing a high output voltage such as, for example, up to about 30 kV, and a tertiary winding for providing a proportional but reduced feedback voltage to adjust the inductance of the transformer secondary as will be more fully explained below with respect to FIG. 6.

As best shown in FIG. 3, the carriage assembly 16 includes biasing means 40 such as coil springs that urge the magnetic shunt 18 movably carried by the carriage assembly against an opposing or first surface 42 of the core 12. Bearings 44, such as roller bearings, engage a second side 46 of the core 12 facing an opposite direction relative to the first side 42 to permit the carriage assembly 16 and the magnetic shunt 18 carried thereon to be moved and positioned along the bottom legs of the first and second C-shaped members 24, 34 and variably across the gap 38 of the core 12 to vary the inductance of the secondary winding of the transformer 10, as will be explained more fully below.

The tuning motor 20 includes a shaft coupling 48 for holding a first end of the drive shaft 22. A second end of the drive shaft 22 threadably engages an end plate 50 of the carriage assembly 16 for moving the magnetic shunt 18 carried by the carriage assembly in a direction away from the motor 20 along the first surface 42 of the bottom legs of the C-shaped members 24, 34 and variably across the gap 38 when the drive shaft rotates in a first direction. Similarly, the drive shaft 22 moves the magnetic shunt 18 in a direction toward the motor and along the first surface 42 of the bottom legs of the C-shaped members 24, 34 and variably across the gap 38 when the drive shaft rotates in a second direction opposite to that of the first direction.

Figure 4:
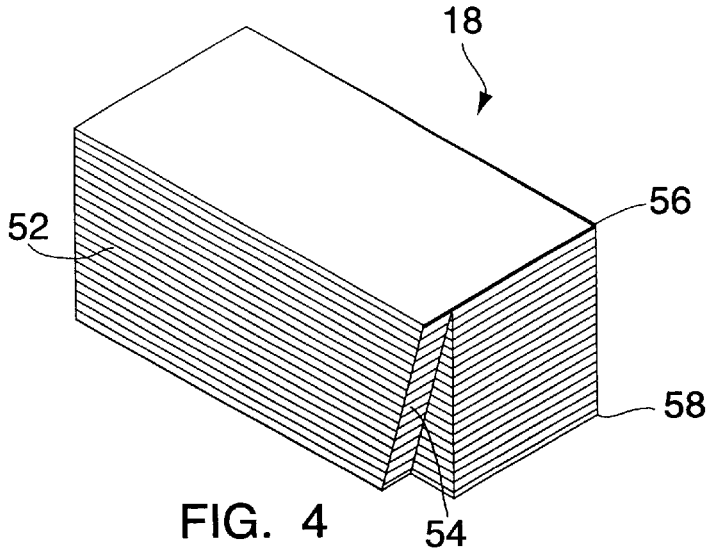
FIG. 4 is a perspective view of a magnetic shunt in accordance with the present invention.

As shown in FIG. 4, the magnetic shunt 18 has a contact surface 52 for engaging and sliding along the opposing or first surface 42 of the C-shaped members 24, 34 and variably across the gap 38. Preferably, the contact surface 52 terminates at an edge 54 extending along an oblique angle from an upper end 56 to a lower end 58 of the magnetic shunt 18 relative to the direction along a longitudinal length of the gap 38 so that the magnetic shunt progressively bridges the gap when moved thereover to prevent sudden changes to the inductance of the secondary winding of the transformer 10.

Figure 6:
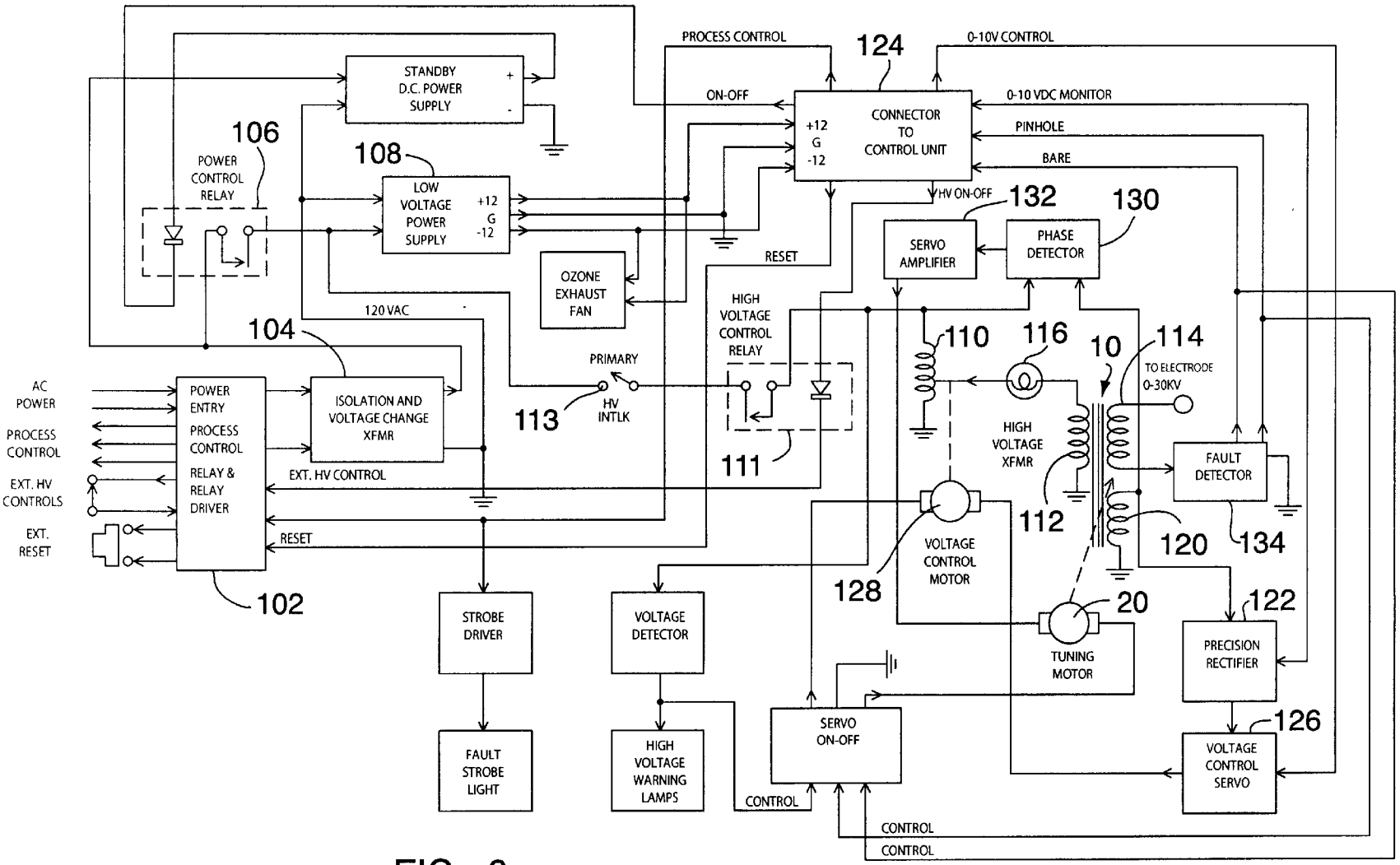
FIG. 6 is a schematic block diagram of a high voltage control circuit for varying the inductance of the transformer of FIG. 1.

Turning now to FIG. 6, an embodiment of a control circuit 100 for automatically adjusting the inductance of the transformer 10 will now be described. A mains voltage of 120 VAC enters the control circuit 100 at a power entry compartment 102 and passes through an LC filter (not shown), an isolation and voltage change transformer 104 and a power control relay 106 to feed low voltage power supplies 108 that generate DC voltages for driving the electronic circuitry. The power entry compartment 102 also includes a process control relay and associated driving circuits.

The isolation transformer 104 includes a primary that receives the mains voltage, and a secondary that generates 120 VAC. The secondary of the isolation transformer 104 energizes a variable transformer 110 via a high voltage control relay 111 and a safety interlock switch 113 which may be disposed on an operator access cover (not shown).

A 0 to 120 VAC output of the variable transformer 110 energizes a primary winding 112 of the variable inductance or step-up transformer 10 to produce a potential across a secondary winding 114 of, for example, 0 to 30 kVAC. A light source such as, for example, a 200 Watt incandescent lamp 116, is connected in series with the primary winding 112 of the variable inductance transformer 10 to limit short circuit secondary current to about 6 milliamperes to prevent electrocution. A high voltage end 118 of the secondary winding 114 is to be coupled to the electrode (not shown) of a spark tester through which a product under test passes.

A tertiary winding 120 of the transformer 10 generates a reduced voltage that is proportional to the high voltage generated across the secondary winding 114. A full wave rectifier 122, preferably employing operational amplifiers, generates a DC voltage proportional to the average AC voltage value generated at the tertiary winding 120. When calibrated, an output in the range of, for example, of 0 to about 10 VDC is generated at the rectifier 122 and represents the RMS value of the high voltage output generated at the secondary winding 114 of the transformer 10.

A control unit 124 including conventional comparator circuitry compares the voltage generated by the rectifier 122 with a fixed reference voltage potential in the range of, for example, 0 to about 10 VDC. The fixed reference potential may be selected at a control unit front panel adjustment or by an external source (not shown) to correspond to the desired high output voltage across the secondary winding 114. A voltage control servo 126 operates a voltage control motor 128 to adjust an input voltage to the variable inductance transformer 10 until the output voltage generated by the rectifier 122 is about equal to the predetermined fixed reference voltage. The voltage control servo 126 thus ensures that the high voltage across the secondary winding 114 of the transformer 10 is made proportional to the predetermined fixed reference voltage potential, and thereby maintained at the predetermined value. This control loop also keeps the AC voltage generated at the secondary winding 114 of the transformer 10 constant during fluctuations in mains voltage and variations in load current.

A phase detector 130 has a first input coupled to the tertiary winding 120 of the transformer 10, and a second input coupled to the input side of the transformer 10. An output of the phase detector 130 is coupled to an input of a servo amplifier 132. The servo amplifier 132, in response to the output of the phase detector 130, maintains the high voltage output signal across the secondary winding 114 of the transformer 10 in phase with the voltage signal across the primary winding 112 by adjusting the inductance of the transformer 10. More specifically, the servo amplifier 132 controllably rotates the drive shaft 22 in the proper direction and distance to move the carriage assembly 16 and the magnetic shunt 18 carried thereon to a proper position in relation to the gap 38 of the core to generate the desired inductance. The proper position along the core 12 may be in a range from an uncovered position not overhanging the gap 38, through intermediate positions overhanging the gap, to a covered position where the magnetic shunt bridges the gap.

When a spark tester is being powered by the transformer 10, the product under test is capacitive such that unity power factor can be achieved by adjusting the inductance of the transformer 10. This result is an improvement in the waveform of the mains voltage and a higher test voltage across the product for a given resistive supply current.

A fault detector 134 senses an arc in the high voltage output of the transformer 10 in the low potential connection of the secondary winding 114.

For example, a bare wire is sensed when a current threshold is exceeded and the output voltage of the transformer 10 falls to zero for a period of time of, for example, at least 60 ms. The AC voltage signal at the tertiary winding 120 of the transformer 10 is rectified by the rectifier 122 to a negative DC bias voltage that is coupled to the fault detector 134 to raise the threshold of detection as the high voltage output is increased across the secondary winding 114 of the transformer 10. The fault detector 134 is coupled to the control unit 124 for alerting a user that a defect has been detected in the product under test.

In operation, the output voltage across the secondary winding 114 of the transformer 10 is automatically adjusted by the control circuit 100 to maintain the voltage across the secondary winding at a high voltage level for a given resistive supply current. Using the spark tester as an example, the high voltage portion of the secondary winding 114 of the transformer 10 is coupled to the electrode of the spark tester. As a length of insulated conductor is moved in contact with and progressively past the electrode, the insulator serving as a load may exhibit a varying capacitance that lowers the output voltage across the secondary winding 114 of the transformer 10 below the predetermined value. The capacitance, in part, is a function of the thickness of the insulator. As the capacitance of the insulator varies, the output voltage across the secondary winding 114 tends to deviate from the predetermined high voltage value. The phase difference between the primary and secondary voltage signals is detected by the control unit 124 which instructs the servo amplifier 132 to controllaby energize the tuning motor 20 to adjust the inductance across the secondary winding 114 to bring or keep in phase the high voltage output signal on the secondary winding 114 with the voltage signal on the primary winding 112. Bringing or maintaining in phase the input and output voltage signals thereby maintains a high voltage output signal for a give resistive supply current.

With reference to FIG. 3, for example, the drive shaft 22 of the tuning motor 20 is controllably rotatable either in a first direction toward the motor 20 or in a second direction away from the motor to move the carriage assembly 16 and the magnetic shunt 18 carried thereon into proper position along the core 12 with respect to the gap 18. More specifically, the magnetic shunt 18 may be positioned against the core so as not to cover the gap, may be positioned to progressively and increasingly overhang the gap, or may be positioned so as to bridge or completely cover the gap. The degree to which the magnetic shunt 18 covers the gap is the degree to which the inductance of the secondary is to be changed in order to bring or maintain in phase the voltage signals on the primary and secondary windings 110, 114 of the transformer 10.

Although the invention has been shown and described in a preferred embodiment, it should be understood that numerous modifications can be made without departing from the spirit and scope of the present invention. Accordingly, the present invention has been shown and described by way of illustration rather than limitation.

What is claimed is:

1. A variable inductance transformer comprising:

a core defining a gap between opposing first and second ends;

a primary winding and at least one secondary winding coupled to the core, the secondary winding for stepping up the voltage across the primary winding;

a magnetic shunt positioned adjacent a length of the core; and a carriage assembly for moving the shunt along the core in a range from an uncovered position at which the shunt does not overhang the gap, through intermediate positions at which the shunt overhangs the gap by varying amounts, to a covered position where the shunt entirely bridges the gap to adjustably vary the inductance of the secondary winding.

2. A variable inductance transformer as defined in claim 1, wherein the core includes two C-shaped members each having first and second ends opposing an associated end of the other C-shaped member, one pair of opposing ends being butted together and the other pair of opposing ends defining the gap therebetween.

3. A variable inductance transformer as defined in claim 1, further including a magnetic insulator disposed within the gap.

4. A variable inductance transformer as defined in claim 1, wherein the carriage assembly includes means for biasing the magnetic shunt against the core.

5. A variable inductance transformer as defined in claim 4, wherein the biasing means is at least one coil spring.

6. A variable inductance transformer as defined in claim 1, further including means for moving the carriage assembly to position the magnetic shunt against the core.

7. A variable inductance transformer as defined in claim 6, wherein the moving means is a motor including a drive shaft threadably engaging the carriage assembly, the drive shaft being rotatable in clockwise and counterclockwise directions to bidirectionally move the magnetic shunt carried by the assembly to a desired position along the core.

8. A variable inductance transformer as defined in claim 1, wherein a contact surface of the magnetic shunt opposing the core terminates at an edge extending along an oblique angle from a first end to a second end relative to a direction along a longitudinal length of the gap whereby the gap is progressively bridged by the magnetic shunt from its first end to its second end when the magnetic shunt is moved over the gap to prevent sudden changes to the inductance of the secondary winding.

9. A variable inductance transformer as defined in claim 1, further including a tertiary winding for generating a signal having a reduced and proportional voltage relative to the voltage on the secondary winding.

10. A variable inductance transformer system comprising:

a variable inductance transformer having a core defining a gap between opposing first and second ends, the transformer including a primary voltage input winding, a secondary voltage output winding, and a tertiary voltage test winding, the secondary winding for generating an output signal having a stepped up voltage relative to that received by the primary winding, and the tertiary winding for generating a signal having a reduced and proportional voltage relative to that generated by the secondary winding;

a carriage assembly including a magnetic shunt movable against the core and variably across the gap, the magnetic shunt having a width at least as wide as the gap for moving the shunt to a predetermined position along the core in a range from an uncovered position not overhanging the gap, through intermediate positions overhanging the gap, to a covered position where the shunt bridges the gap to adjustably vary the inductance of the secondary winding; and means for moving the carriage assembly to position the magnetic shunt against the core.

11. A variable inductance transformer system as defined in claim 10, wherein the moving means includes:

a motor having a drive shaft threadably engaging the carriage assembly, the drive shaft being rotatable in clockwise and counterclockwise directions to bidirectionally move the magnetic shunt carried by the assembly to a desired position along the core; and a control circuit for controllably energizing the motor.

12. A variable inductance transformer as defined in claim 11, wherein the control circuit includes:

a phase detector having inputs communicating with the input and output sides of the transformer; and a servo amplifier having an input coupled to an output of the phase detector, and an output coupled to a control input of the tuning motor for controllably energizing the tuning motor to move the magnetic shunt into a position along the core so that the voltage signals at the input and output sides of the transformer are in a predetermined phase relation to each other.

13. A variable inductance transformer as defined in claim 12, wherein the servo amplifier controllably energizes the tuning motor to move the magnetic shunt into a position along the core so that the voltage signals at the input and output sides of the transformer are in phase with each other.

14. A variable inductance transformer as defined in claim 12, wherein the control circuit further includes:

a second variable transformer having an output communicating with the primary winding of the variable inductance transformer;

a voltage control motor for adjusting the output voltage of the second variable transformer;

a rectifier having an input coupled to the tertiary winding of the variable inductance transformer; and a voltage control servo having a first input coupled to an output of the rectifier, a second input for receiving a fixed reference voltage, and an output coupled to a control input of the voltage control motor, the voltage control servo for energizing the voltage control motor to adjust the output voltage of the second variable transformer so that the high voltage output of the variable inductance transformer is maintained at a predetermined value.

* * * * *